US007407307B2

(12) United States Patent
Hiratsuka

(10) Patent No.: US 7,407,307 B2
(45) Date of Patent: Aug. 5, 2008

(54) ILLUMINATING PANEL AND ILLUMINATING DEVICE

(75) Inventor: Toshio Hiratsuka, Tokyo (JP)

(73) Assignee: Kabushikikaisha Mirai, Tokyo (JP)

( * ) Notice: Subject to any disclaimer, the term of this patent is extended or adjusted under 35 U.S.C. 154(b) by 0 days.

(21) Appl. No.: 11/596,540

(22) PCT Filed: Aug. 29, 2006

(86) PCT No.: PCT/JP2006/316973

§ 371 (c)(1),
(2), (4) Date: Feb. 5, 2007

(87) PCT Pub. No.: WO2007/026696

PCT Pub. Date: Mar. 8, 2007

(65) Prior Publication Data

US 2007/0217192 A1 Sep. 20, 2007

(30) Foreign Application Priority Data

Aug. 30, 2005 (JP) ..... 2005-249984

(51) Int. Cl.
*F21V 7/00* (2006.01)

(52) U.S. Cl. ..... 362/304; 362/241; 362/247; 362/346; 362/518; 362/545; 362/612; 362/800

(58) Field of Classification Search ..... 362/241, 362/243, 247, 301, 302, 346, 517, 518, 545, 362/612, 800

See application file for complete search history.

(56) References Cited

U.S. PATENT DOCUMENTS 6,485,170 B2 * 11/2002 Natsume ..... 362/517
7,008,079 B2 * 3/2006 Smith ..... 362/241

FOREIGN PATENT DOCUMENTS

| | | |
|---|---|---|
| JP | 63-33878 | 2/1988 |
| JP | 04-123841 | 11/1992 |
| JP | 2000-021209 | 1/2000 |
| JP | 2000-216437 | 8/2000 |
| JP | 2002-93209 | 3/2002 |
| JP | 2004-128434 | 4/2004 |
| WO | WO 2007/026696 A1 | 3/2007 |

OTHER PUBLICATIONS

International Search Report dated Feb. 2, 2007.

* cited by examiner

*Primary Examiner*—Stephen F Husar
(74) *Attorney, Agent, or Firm*—McGinn IP Law Group PLLC

(57) ABSTRACT

An illuminating panel has disposed thereon a plurality of linear light source units, and the linear light source units each include: a light emitter having a plurality of light emitting diodes linearly installed on a base; a first reflector formed of parabolic surfaces which are provided on a light emergence side of the light emitter in such a way as to correspond to the plurality of light emitting diodes, and light emitting faces of which fall in focal positions; and a second reflector having a pair of flat plate-like reflecting surfaces which, being arranged with the light emitting diodes sandwiched therebetween, farther to the light emergence side than the first reflector and parallel to an array direction of the light emitting diodes, reflect light from the light emitting diodes toward the light emergence side, wherein the linear light source units are annularly disposed on a module panel.

27 Claims, 14 Drawing Sheets

ILLUMINATING PANEL AND ILLUMINATING DEVICE

TECHNICAL FIELD

The present invention relates to an illuminating panel and an illuminating device.

BACKGROUND ART

A hitherto known luminaire has used various types of illuminating light sources, such as a fluorescent lamp, an incandescent lamp and a spot light, but there have been many limitations on its installation due to its illuminating light containing an ultraviolet component inducing a deterioration of an illuminated subject and to a heat generation of the illuminating light sources. Recently, since an LED light source having less heat generation and power consumption has attracted more attention, and a white LED having a high luminance has also been provided, there is an increasing number of luminaires for general lighting using the LED light source. An example of this kind of illuminating device is disclosed in, for example, Patent Document 1.

Also, to date, in a case of an illuminating device, in order to obtain a desired illuminance, individual luminaries have been disposed on a ceiling or the like at prescribed spaced intervals. Consequently, an operation to previously determine an attachment position of each luminaire has been carried out at an illuminating device installation site.

Patent Document 1: JP-A-2000-021209

DISCLOSURE OF THE INVENTION

Problems that the Invention is to Solve

However, as in Patent Document 1 described heretofore, in the illuminating device with an LED as its light source, in a case of configuring the illuminating device in such a way as to have a single LED or a plurality of LED's in an array formation, an irradiated area of illuminating light is widened in a case of a wide illuminance angle of the LED itself, while an illuminance drops significantly with distance from the light source, meaning that the illuminating device cannot perform satisfactorily. In this case, it is sufficient that an emission of the LED itself is increased in luminance, but it causes a problem in that a disadvantage due to an increase in size and power consumption of the device is inevitable. Accordingly, by a reflecting plate having a concave paraboloid being provided on a side (a back side or the like) of the LED, it is possible to use the reflecting plate to parallelize light from the LED and increase a luminous flux density, but an optic component not having been projected onto the reflecting plate proceeds to a forward optical path while diffusing. For this reason, an illuminance distribution of the whole light source is increased in illuminance by the reflecting plate, but the whole light source still remains presenting a broad distribution, and it is impossible to obtain a sufficient illuminated area having a high illuminance and a flat illuminance distribution necessary for illumination. Also, even in the event that a luminaire capable of forming an illuminated area having a high illuminance and a flat illuminance distribution can be obtained, in order to be able to obtain a desired illuminance, a cumbersome positioning operation to previously determine an attachment position of each luminaire has been needed. In this case, in the event that, for example as shown in FIG. 14(*a*), a multiplicity of luminaries 500 is aligned without being positioned, a prescribed illuminance can be obtained but, as shown in FIGS. 14(*b*) and (*c*), a whole irradiated area becomes a collection of nonuniform illuminance areas 503*a*, 503*b*, 503*c* and 503*d*, resulting in a severe reduction in illumination quality.

The invention has been conceived with the above circumstances in mind, and a first object of the invention is to obtain an illuminating panel by which an illuminated area having a high illuminance and a stable flat illuminance distribution can be formed with a long irradiation distance while power is being saved. Also, a second object of the invention is to obtain an illuminating device by which an irradiated area having a high illuminance and a uniform illuminance distribution can be developed into an optional width with ease.

Means for Solving the Problems

The above objects are achieved by the following configuration.

(1) An illuminating panel having disposed thereon a plurality of linear light source units, the linear light source units each including: a light emitter having a plurality of light emitting diodes linearly installed on a base; a first reflector formed of parabolic surfaces which are provided on a light emergence side of the light emitter in such a way as to correspond to the plurality of light emitting diodes, and light emitting faces of which fall in focal positions; and a second reflector having a pair of flat plate-like reflecting surfaces which, being arranged with the light emitting diodes sandwiched therebetween, farther to the light emergence side than the first reflector and parallel to an array direction of the light emitting diodes, reflect light from the light emitting diodes toward the light emergence side, wherein the linear light source units are annularly disposed on a module panel.

In this illuminating panel, the first reflector reflects light from the light emitting diodes toward the light emergence side while making it approximately parallel, and the second reflector reflects light from the light emitting diodes, which has not fallen incident on the first reflector, toward the light emergence side while making it approximately parallel, thereby saving power and yet equalizing an illuminance distribution with a high illuminance. In addition, an irradiated area having a high illuminance and a uniform illuminance distribution, obtained by the individual linear light source units, can be expanded uniformly in all directions from a center of the irradiated area. Furthermore, an overlapping irradiated area having a higher illuminance and a uniform illuminance distribution, which is irradiated with light from all the linear light source units, can be formed in a central portion of the expanded irradiated area. That is, it is possible to secure a wide overlapping irradiated area having a high illuminance and a uniform illuminance distribution.

(2) An illuminating panel according to (1), wherein the linear light source units are disposed along each side of the module panel formed in a polygonal shape.

In this illuminating panel, as the linear light units can be annularly disposed using each side which forms a periphery of the polygonal shape, light emerges from each side of one module panel, and a uniform irradiated area can be formed by one module panel.

(3) An illuminating panel according to (2), wherein the polygonal shape is a square.

In this illuminating panel, by the polygonal shape being a square, emergent light from each side is expanded in four directions from a center of the irradiated area and, additionally, an overlapping irradiated area having a higher illuminace and a uniform illuminance distribution, which is irradiated with light from all the linear light source units, can be formed into a square in a central portion of the expansion.

(4) An illuminating panel according to (3), wherein the polygonal shape is a triangle.

In this illuminating panel, by the polygonal shape being a triangle, a number of linear light source units can be reduced by one as compared with the case of the square, making it possible to reduce the module panel in size while expanding emergent light from each side uniformly in three directions from a center of the irradiated area.

(5) 5. An illuminating device, wherein a plurality of illuminating panels according to any one of (1) to (4) is connected and arranged in an array formation.

In this illuminating device, by minimum unit module panels each having a plurality of linear light source units annularly provided thereon being continuously arrayed (continued), an overlapping irradiated area having a high illuminance and a uniform illuminance distribution can be easily developed into an optional width.

Advantage of the Invention

According to the illuminating panel of the invention, as a linear light source unit is configured of: a light emitter having light emitting diodes linearly installed thereon; a first reflector formed of parabolic surfaces; and a second reflector having flat plate-like reflecting surfaces arranged farther to the light emergence side than the first reflector, the first reflector reflects light from the light emitting diodes toward the light emergence side while making it approximately parallel, and the second reflector reflects light from the light emitting diodes, which has not fallen incident on the first reflector, toward the light emergence side while making it approximately parallel, thereby enabling a power saving and yet an illuminance distribution equalization with a high illuminance. Furthermore, as the linear light source units are annularly disposed on the module panel, an irradiated area having a high illuminance and a uniform illuminance distribution, obtained by the individual linear light source units, can be expanded uniformly in all directions from a center of the irradiated area. In addition, an overlapping irradiated area having a higher illuminance and a uniform illuminance distribution, which is irradiated with light from all the linear light source units, can be formed in a central portion of the expanded irradiated area. As a result, it is possible to, while saving power, form the overlapping irradiated area, which has a high illuminance and a stable flat illuminance distribution, with a long irradiation distance.

According to the illuminating device, as a plurality of the illuminating panels is connected and arranged in an array formation, by arraying minimum unit module panels each provided with the linear light source unit, an overlapping irradiated area having a high illuminance and a uniform illuminance distribution can be developed into an optional width with ease.

DESCRIPTION OF REFERENCE NUMERALS AND SIGNS

Figure 1:
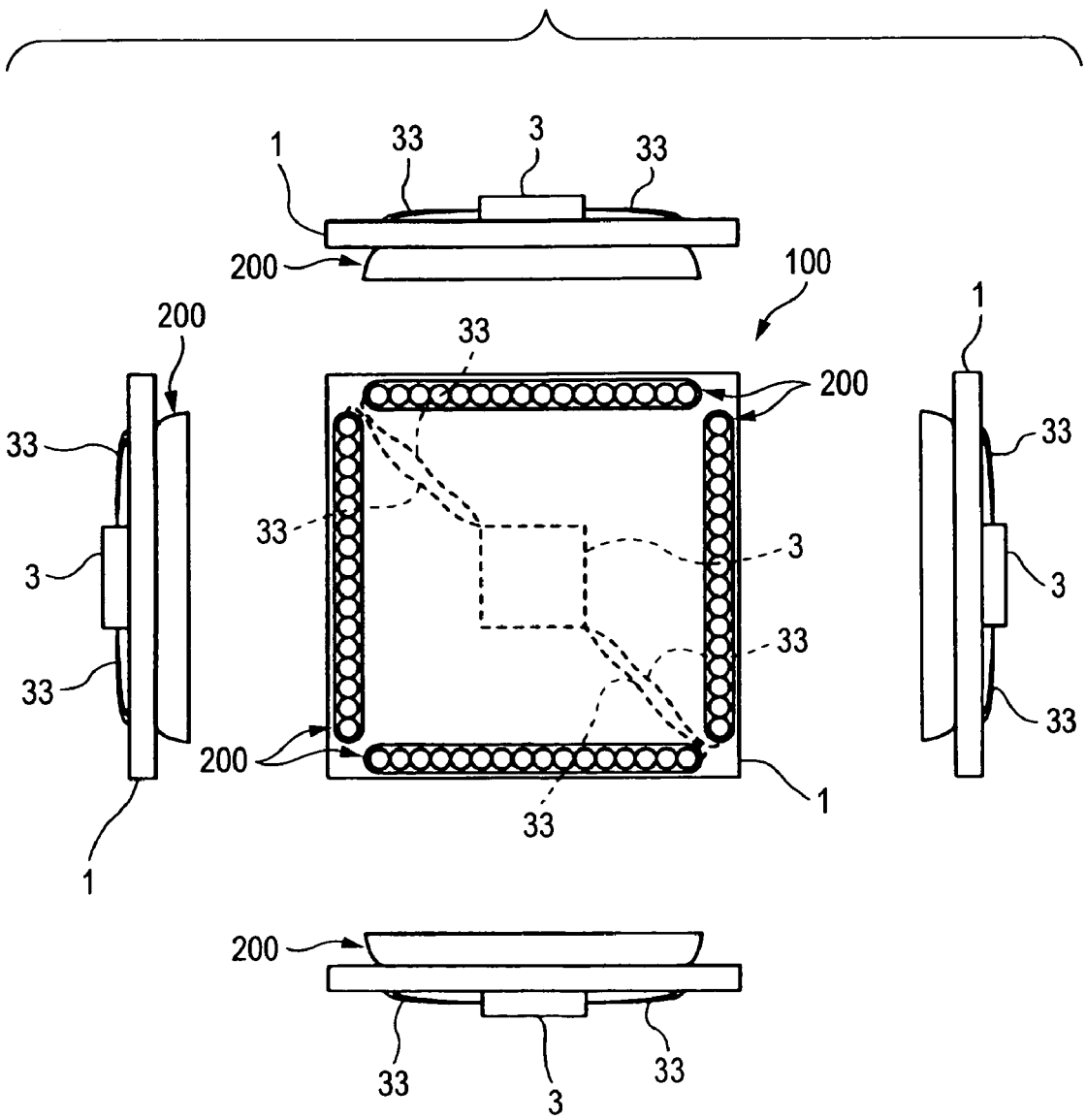
[FIG. 1] An external view, including a bottom view of an illuminating panel according to the invention in the center, and side views thereof seen from four directions on the left, right, top and bottom.

1 Module panel
17 LED (light emitting diode)
19 Wiring board (base)
21 Light emitter
25 First reflector
27 Second reflector
100 Illuminating panel
200 Linear light source unit
300 Illuminating device

BEST FOR CARRYING OUT THE INVENTION

Hereafter, a detailed description will be given, with reference to the drawings, of a preferred embodiment of an illuminating panel and an illuminating device according to the invention.

Figure 2:
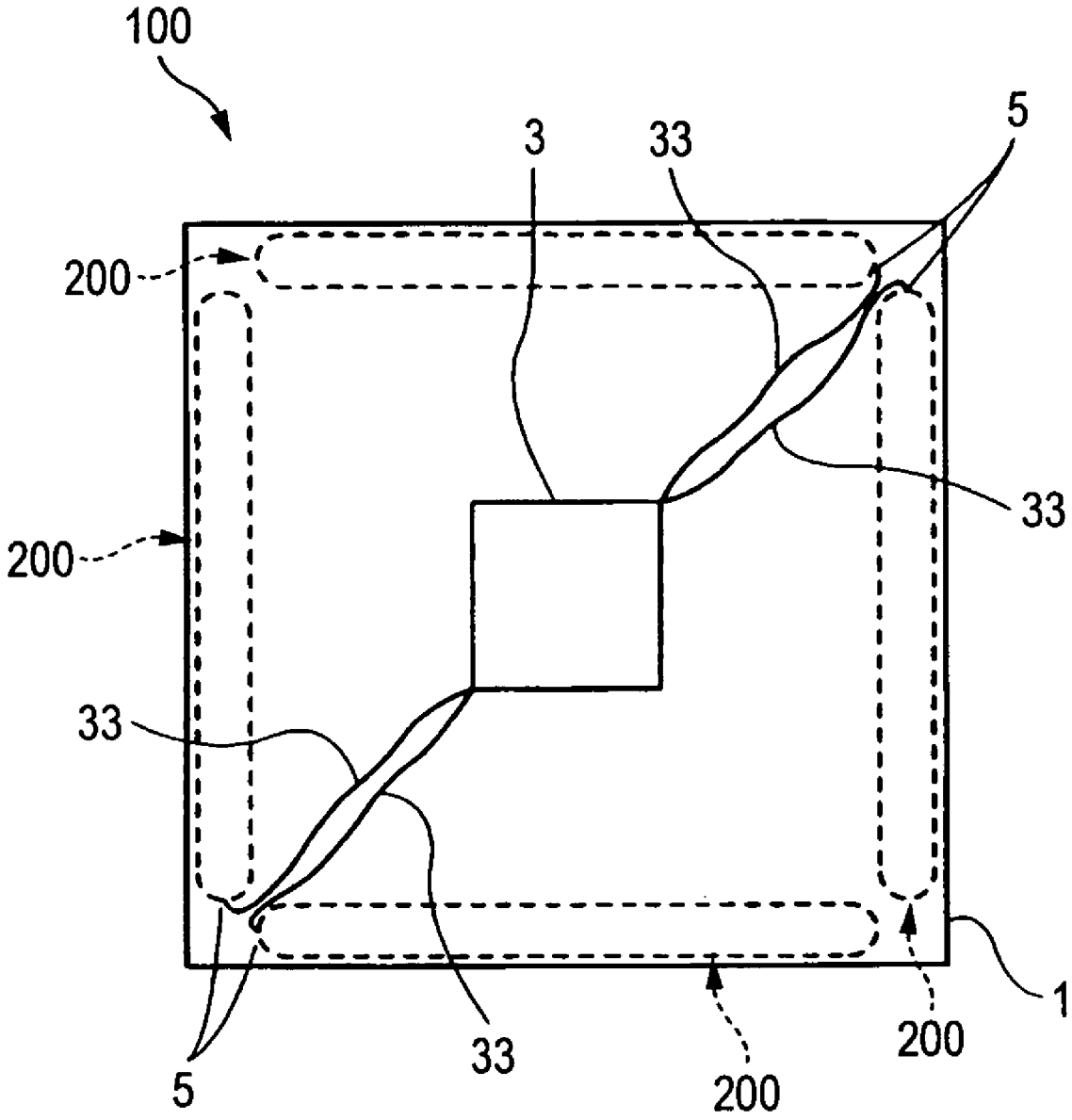
[FIG. 2] A plan view of the illuminating panel shown in FIG. 1 as seen from above.

FIG. 1 is an external view, including a bottom view of the illuminating panel according to the invention in the center, and side views thereof seen from four directions on the left, right, top and bottom, and FIG. 2 is a plan view (a view showing the backside of FIG. 1) of the illuminating panel shown in FIG. 1 as seen from above.

An illuminating panel 100 has a plurality (in the embodiment, four) of linear light source units 200, to be described hereafter, disposed annularly (in the embodiment, in a quadrangular formation) on a module panel 1 made of an opaque resin material or the like. When the module panel 1 is installed, a surface thereof, on which is disposed the linear light source unit 200, is used as a lower surface, and an upper surface opposite thereto is attached to a ceiling, transferring means or the like. A housing box 3 is affixed to the upper surface of the module panel 1, housing a drive unit 11 (refer to FIG. 3), to be described hereafter, and the like. Through holes 5 and 5 shown in FIG. 2 are bored at each end in one diagonal direction of the module panel 1, and the through holes 5 have wire leads 33 of the corresponding linear light source units 200 passing through them from the lower surface to the upper surface of the module panel 1. The wire leads 33 passing through to the upper surface side are connected to the drive unit 11 in the housing box 3.

The linear light source units 200 are disposed along each side of the module panel 1 formed in a polygonal shape. In this way, by the linear light source units 200 being annularly disposed using each side which forms a polygonal periphery, light is caused to emerge from each side of one module panel 1, enabling a formation of a uniform illuminated area using one module panel 1. In the embodiment, the module panel 1 is square.

Next, a description will be given of the linear light source unit 200.

Figure 3:
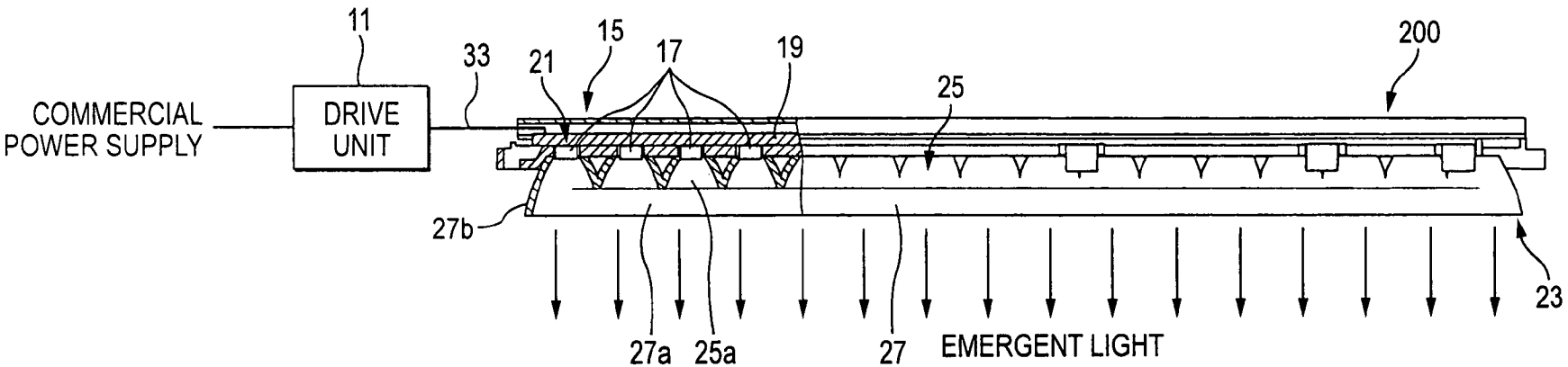
[FIG. 3] An overall configuration view of a linear light source unit shown in FIG. 1.

FIG. 3 is an overall configuration view of the linear light source unit shown in FIG. 1.

As shown in FIG. 3, the drive unit 11 is connected to the linear light source unit 200. The drive unit 11, being for supplying the linear light source unit 200 with a light emission drive power, can use, for example, a full-range transformer. The drive unit 11, being connected to a commercial power supply, converts an electric power of, for example, AC110V to 220V, 50 Hz to 60 Hz from the commercial power supply, into a drive voltage of DC12V (an optional voltage of, for example, DC6V or DC24V, or an alternating current is also acceptable) and supplies it to the linear light source unit 200.

The linear light source unit 200 is configured to include a rear plate 15, a light emitter 21 having a multiplicity of light emitting diodes (LED's) 17 linearly arranged on a wiring board 19 which is a base, and a reflecting mirror member 23. The rear plate 15, with the wiring board 19 sandwiched between it and the reflecting mirror member 23, is removably attached to the reflecting mirror member 23.

The LED's 17 each include a blue light emitting diode and a phosphor which converts blue light from the blue light emitting diode into yellow light. In this way, in the LED's 17, when blue light emerging from the blue light emitting diode is absorbed by the phosphor, the phosphor exhibits yellow light of a shorter wavelength and, by the yellow light mixing with blue light not having been absorbed, white light is produced as emergent light. The emergent light of the LED's 17 is not limited to the white light.

Figure 4:
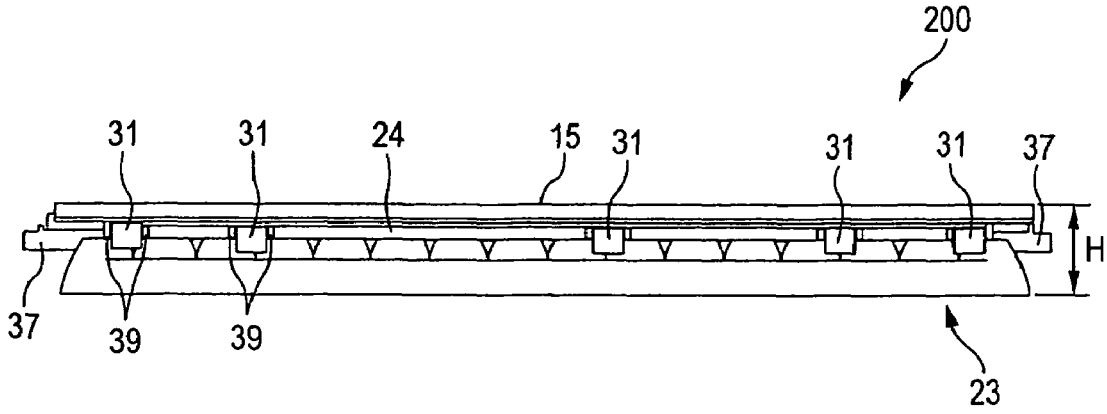
[FIG. 4] A side view (a) and a bottom view (b) of the linear light source unit.
Figure 4:
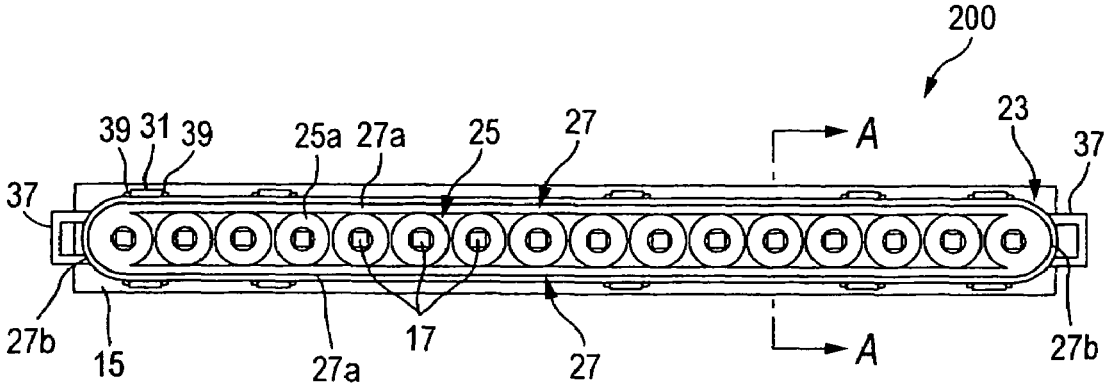
Figure 5:
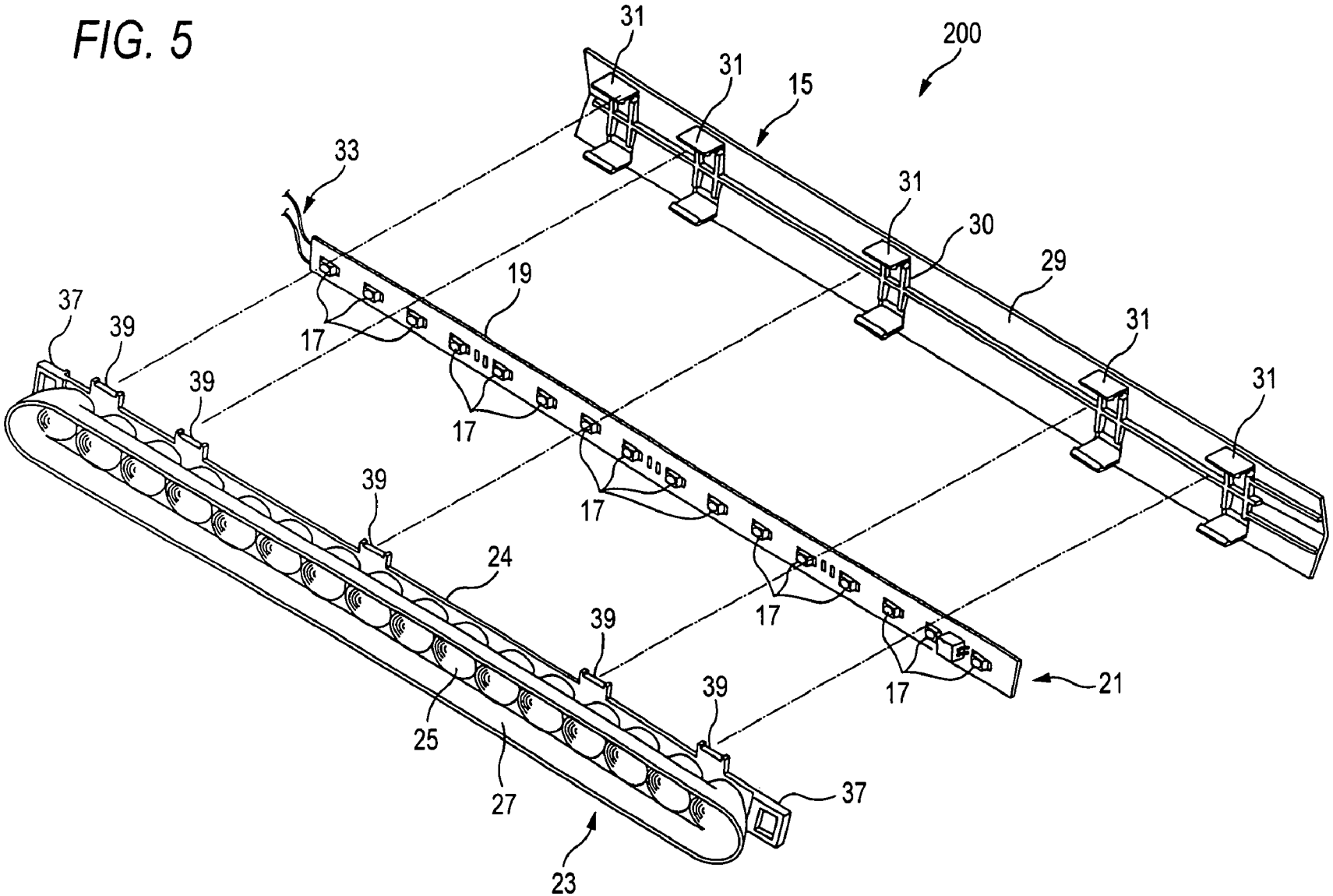
[FIG. 5] An exploded perspective view of the linear light source unit.

FIG. 4 shows a side view (a) and a bottom view (b) of the linear light source unit, and FIG. 5 is an exploded perspective view of the linear light source unit.

As shown in FIG. 4(*a*), the linear light source unit 200 has a height H in a condition in which the rear plate 15 is attached to the reflecting mirror member 23. The height H is largely in the order of 20 mm in the embodiment, resulting in a drastic reduction in thickness as compared with a case in which a heating lamp, a fluorescent lamp or the like is used as a light source. In the event that the height H is too small, deflection characteristics of the reflecting mirror member 23 are impaired while, in the event that it is too large, an installation space is required, preventing an enhancement of a disposition freedom of the linear light source unit 200. For this reason, it is desirable that the height H is in the order of 15 to 30 mm, particularly, in the order of 20 to 23 mm.

As shown in FIG. 4(*b*), the reflecting mirror member 23 integrally includes along plate-like attachment base 24 (refer to FIG. 5), a first reflector 25 formed with a plurality (in the embodiment, a total of 16) of parabolic reflecting surfaces (parabolic mirrors) 25*a* each of which is connected to the attachment base 24 and, having an opening in a center position, opens to a light emergence side, and a second reflector 27 which, being provided farther to the light emergence side than the first reflector 25, is formed with a flat plate-like reflecting surface (a planar mirror) 27*a* parallel to an array direction of the parabolic mirrors 25*a*. The second reflector 27 being formed with a pair of the planar mirrors 27*a* in a direction perpendicular to the array direction of the parabolic mirrors 25*a*, both ends on each side in the array direction are connected by a parabolic wall 27*b* formed by extending a parabolic mirror of the first reflector 25. The reflecting mirror member 23 is a resin molding integrally molded by injection molding, and at least light reflecting surfaces of the first reflector 25 and the second reflector 27 are mirror coated by aluminum evaporation or the like. Also, without being limited to this, it is possible to use another common practice as the light reflecting surface.

As shown in FIG. 5, the rear plate 15 includes a shade 29 having a dogleg shape in vertical section, a rib 30 supporting a back side of the wiring board 19 on an inner surface of the shade 29, and locking claws 31 which, engaging with the reflecting mirror member 23, are installed at a plurality (in the embodiment, five) of points in a longitudinal direction of the shade 29. The locking claws 31 are formed as a pair of upper and lower hooks, as seen in the figure, combining into a squared U-shape in vertical section.

The wiring board 19 is, for example, a printed-wiring board, and a plurality (herein, 16) of LED's 17 corresponding to the individual parabolic mirrors 25*a* are linearly mounted on the reflecting mirror member 23 side in a longitudinal direction of the wiring board 19. Then, the wire leads 33 are led out from one end of the wiring board 19 and connected to the drive unit 11 (refer to FIG. 3). As the wiring board 19 is a one side mounting module, it is a safe module for which it is easy to find a problem in case of trouble and which has an excellent maintainability.

The reflecting mirror member 23 has a bracket 37, which is used for securing the linear light source unit 200, formed at each end of the attachment base 24 formed as a long flat plate, and has engagement portions 39, with which are engaged the locking claws 31 of the rear plate 15, provided in a vertical direction, as seen in FIG. 1, of the attachment base 24. The reflecting mirror member 23, the wiring board 19 and the rear plate 15 are removably fitted together by a snap engagement of the engagement portions 39 with the locking claws 31 of the rear plate 15 in such a way that the wiring board 19 is sandwiched between the reflecting mirror member 23 and the rear plate 15.

When the reflecting mirror member 23, the wiring board 19 and the rear plate 15 are fitted together, light emitting faces of the LED's 17 are positioned in focal positions of the parabolic mirrors 25*a* of the first reflector 25. In this case, that is, surfaces abutting against a surface of the wiring board 19 are discretely disposed on the reflecting mirror member 23, and the abutment surfaces are formed to have a height at which the light emitting faces of the LED's 17 fall in the focal positions of the parabolic mirrors 25*a*. Also, when the wiring board 19 is housed in a board housing position formed in the reflecting mirror member 23, a height of the rib 30 of the rear plate 15 is set in such a way that the rib 30 presses the wiring board 19 against the abutment surfaces.

Consequently, simply by fitting the reflecting mirror member 23, the wiring board 19 and the rear plate 15 together, the focal positions of the parabolic mirrors 25*a* and the light emitting faces of the LED's 17 match with ease and high accuracy. By this configuration, it is possible to facilitate attachment without using fastening means such as, for example, a screw, reduce a number of parts, and ease a process for assembly and adjustment, improving a productivity.

Next, a description will be given of optical characteristics of the heretofore described configuration with respect to the linear light source unit 200.

Figure 6:
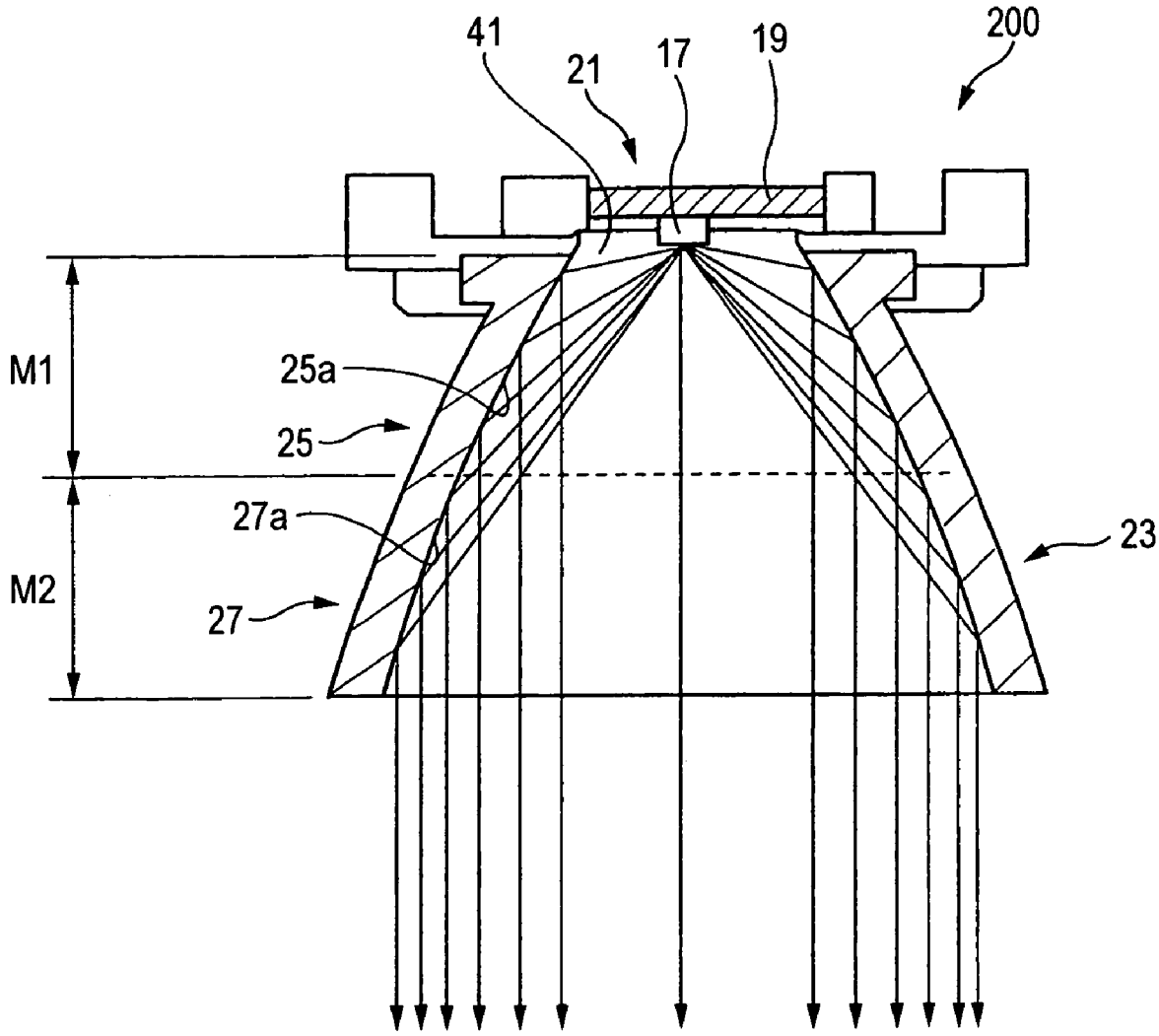
[FIG. 6] A sectional view of the linear light source unit shown in FIG. 4 taken along line A-A thereof.

FIG. 6 is a sectional view of the linear light source unit shown in FIG. 4 taken along line A-A thereof.

The reflecting mirror member 23 of the linear light source unit 200 has the first reflector 25 and the second reflector 27 continuously formed, and a proximal end of the first reflector 25 is provided with an opening 41 for disposing the light emitting face of the LED 17 in the focal position of the parabolic mirror 25*a*. The parabolic mirror 25*a* of the first reflector 25 has a parabolic reflecting surface with the light emitting face of the LED 17 as a focal position, and reflects light from the LED 17 toward the light emergence side while making the light approximately parallel.

Also, the second reflector 27, being provided farther to the light emergence side than the first reflector 25, includes the flat plate-like planar mirror 27*a* disposed parallel to the array direction of the parabolic mirrors 25*a*, that is, the array direction of the LED's 17. Then, the second reflector 27 receives light from the LED 17, which has not been projected onto the first reflector 25, and reflects it toward the light emergence side while making it approximately parallel. As the first reflector 25 has a predetermined reflecting surface area M1, and the second reflector 27 has a predetermined reflecting surface area M2 contiguous with the reflecting surface area M1, the light reflected by the first and second reflectors 25 and 27 is converted into parallel light of a large light quantity, and the parallel light is projected onto an illuminated subject.

A gradient angle of the planar mirror 27*a* with respect to an optical axis of the LED 17 is set at an angle at which a luminous flux from the LED 17, which has not been projected onto the first reflector 25, is converted into parallel light. In the case of the embodiment, the gradient angle is set within a range of 20° to 27° with respect to the optical axis of the LED 17.

At this point, the LED 17 has a wide illuminance angle such as, for example, 120° and, even though laterally emerging optic components increase from among the emergent light, as they are caught by the first reflector 25 and the second reflector 27, a proportion contributing to light parallelization is heightened. By this means, an illuminance distribution equalization effect is further enhanced.

Next, a description will be given of an illuminance area obtained by the linear light source unit 200.

Figure 7:
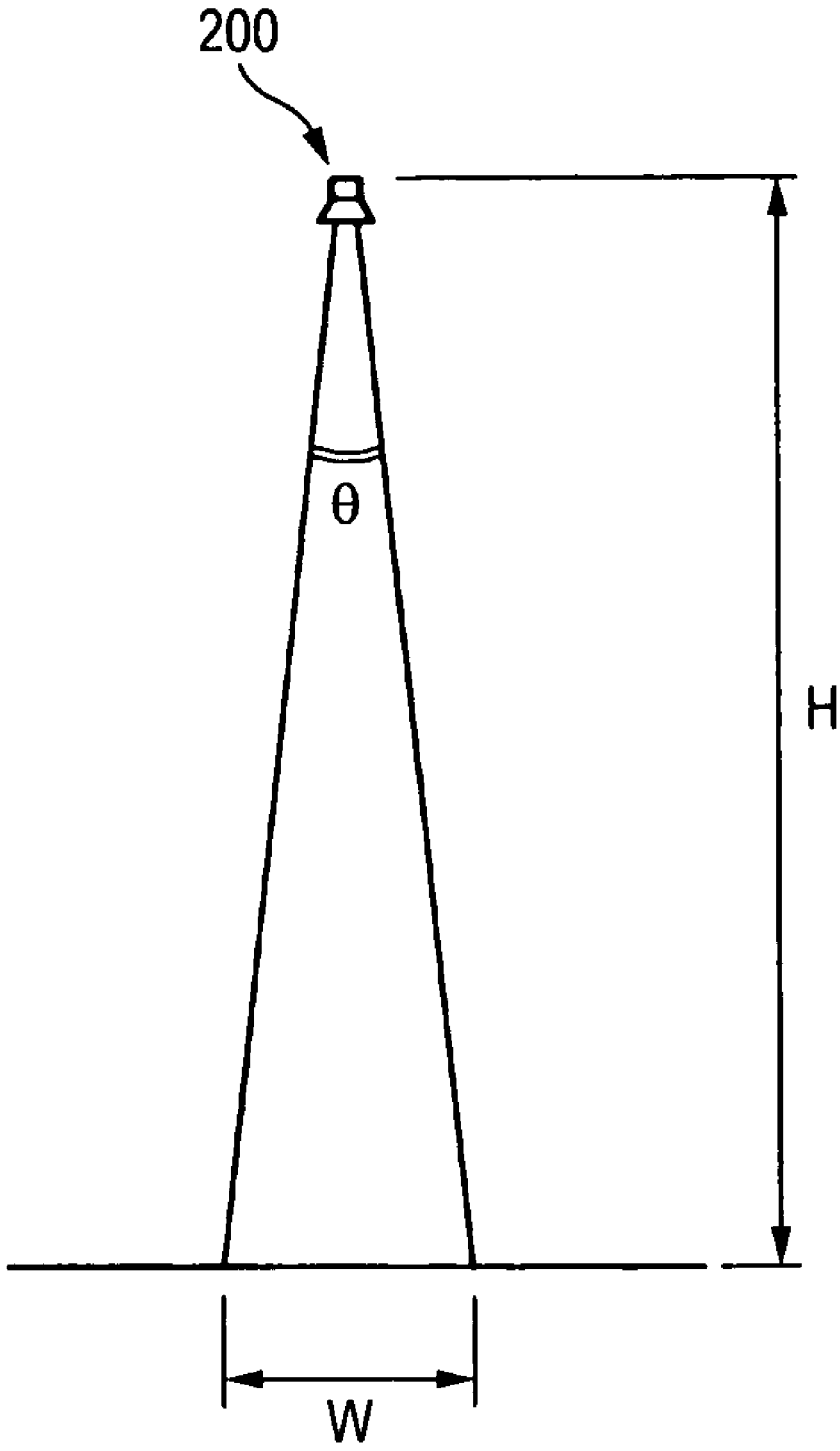
[FIG. 7] A schematic diagram representing a correlation between an irradiation distance and an irradiated area in the linear light source unit.

FIG. 7 is a schematic diagram representing a correlation between an irradiation distance and an irradiated area in the linear light source unit.

In the linear light source unit 200, when a light quantity in a range W, which includes an optic component directly projected from the LED 17 and an optic component having arrived through a reflection by the first reflector 25 and the second reflector 27, is compared with that in any other area, a boundary between them appears clearly. This is for the reason that light is converged in the range W, and a luminous flux is converted into approximately parallel light, and that an irradiance is in a high condition. By changing an open angle θ of the planar mirror 27*a* with respect to the optical axis of the LED 17, it is possible to adjust an optical deflection. That is, it is possible to widen an illuminated range by increasing the open angle θ, and to converge light in a specified position by reducing the open angle θ. In this case, it is preferable to configure in such a way that the first reflector and the second reflector are provided separately rather than being integrally configured, and the open angle θ is adjustable.

Figure 8:
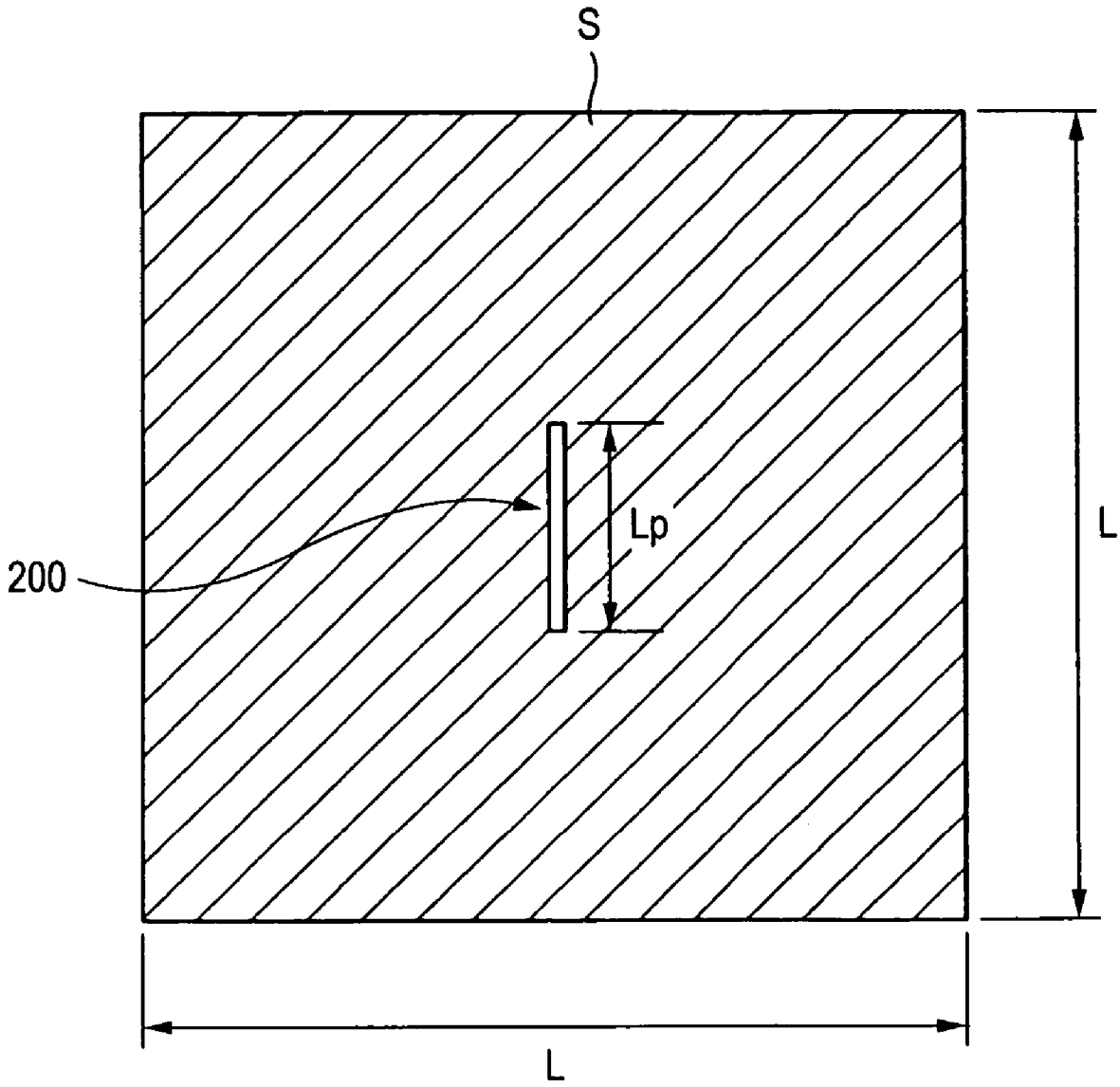
[FIG. 8] A schematic diagram representing an irradiated area obtained by a single linear light source unit.

FIG. 8 is a schematic diagram representing an illuminated area obtained by a single linear light source unit.

In the embodiment, when the open angle θ is set at about 11° and a property of the linear light source unit 200 is as follows:

A number of LED's 16

An outside dimension of the reflecting mirror member 23

23.8 mm in length, 264 mm in width, and 16.25 mm in height, in a case in which an irradiation distance H is about 5 m, a square irradiated area S shown in FIG. 8, a length L of each side of which is about 1 m, is formed.

Figure 9:
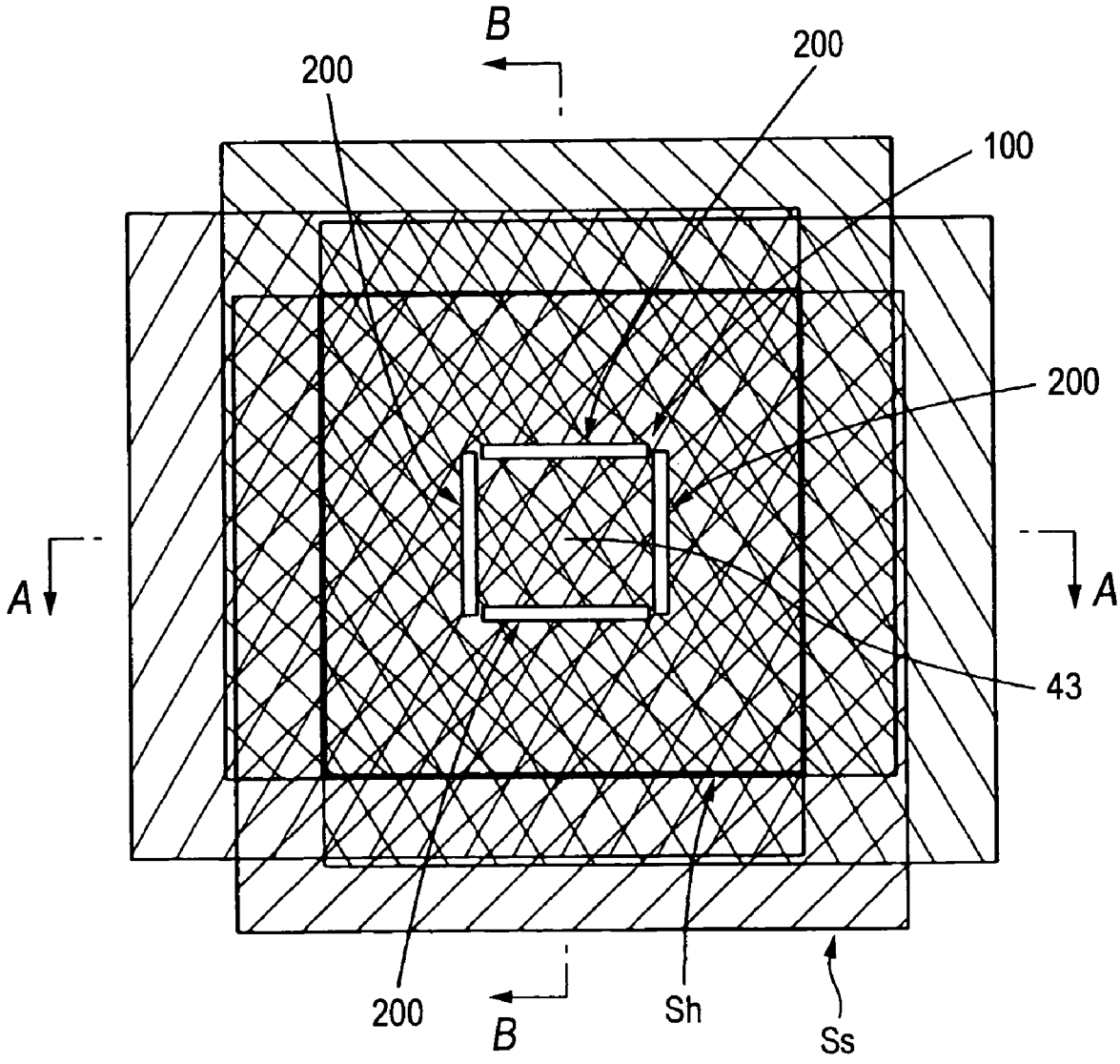
[FIG. 9] A schematic diagram representing an irradiated area obtained by the illuminating panel.
Figure 10:
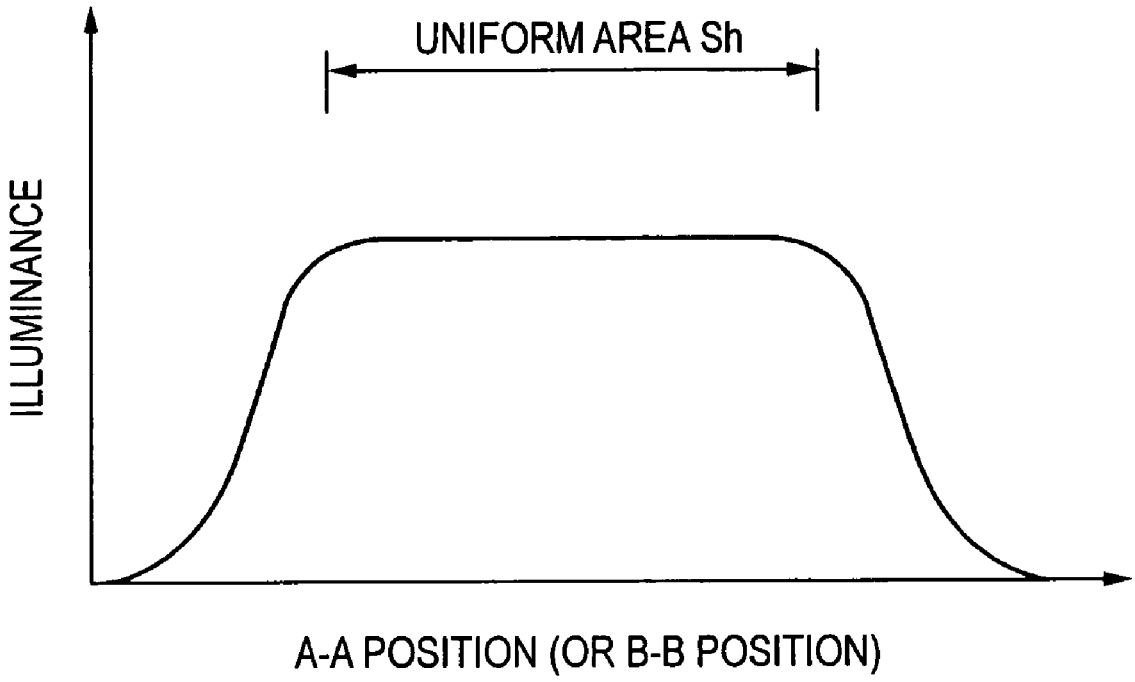
[FIG. 10] A graph representing an illuminance distribution obtained by the illuminating panel.

FIG. 9 is a schematic diagram representing an irradiated area obtained by the illuminating panel, and FIG. 10 is a graph representing an illuminance distribution obtained by the illuminating panel.

In the illuminating panel 100 equipped with the linear light source unit 200 described heretofore, by the polygonal shape of the module panel 1 being a square, as shown in FIG. 9, emergent light from each side is expanded uniformly in four directions from a center 43 of an irradiated area SS. In addition, light is projected from all the linear light units 200 onto a central portion of the expansion. As such, an overlapping irradiated area Sh having a higher illuminance and the uniform illuminance distribution shown in FIG. 10 is formed into a square.

Consequently, according to the illuminating panel 100, as the linear light source unit 200 is configured of the light emitter 21 having the LED's 17 linearly arranged, the first reflector 25 formed of the parabolic mirrors 25*a*, and the second reflector 27 having the flat plate-like planar mirrors 27*a* disposed farther to the light emergence side than the first reflector 25, the first reflector 25 reflects light from the LED's 17 toward the light emergence side while making it approximately parallel, and the second reflector 27 reflects light, which has not fallen incident on the first reflector 25, toward the light emergence side while making it approximately parallel, thereby enabling a power saving and yet an illuminance distribution equalization with a high illuminance.

Furthermore, as the linear light source units 200 are annularly disposed on the module panel 1, an irradiated area having a high illuminance and a uniform illuminance distribution, obtained by the individual linear light source units 200, can be expanded uniformly in all directions from the center 43 of the irradiated area Ss. In addition, the overlapping irradiated area Sh having a higher illuminance and a uniform illuminance distribution, which is irradiated with light from all the linear light source units 200, can be formed in a central portion of the expanded irradiated area. As a result, it is possible to, while saving power, form the overlapping irradiated area Sh, which has a high illuminance and a stable flat illuminance distribution, with a long irradiation distance H.

Next, a description will be given of various modification examples of the illuminating panel.

Figure 11:
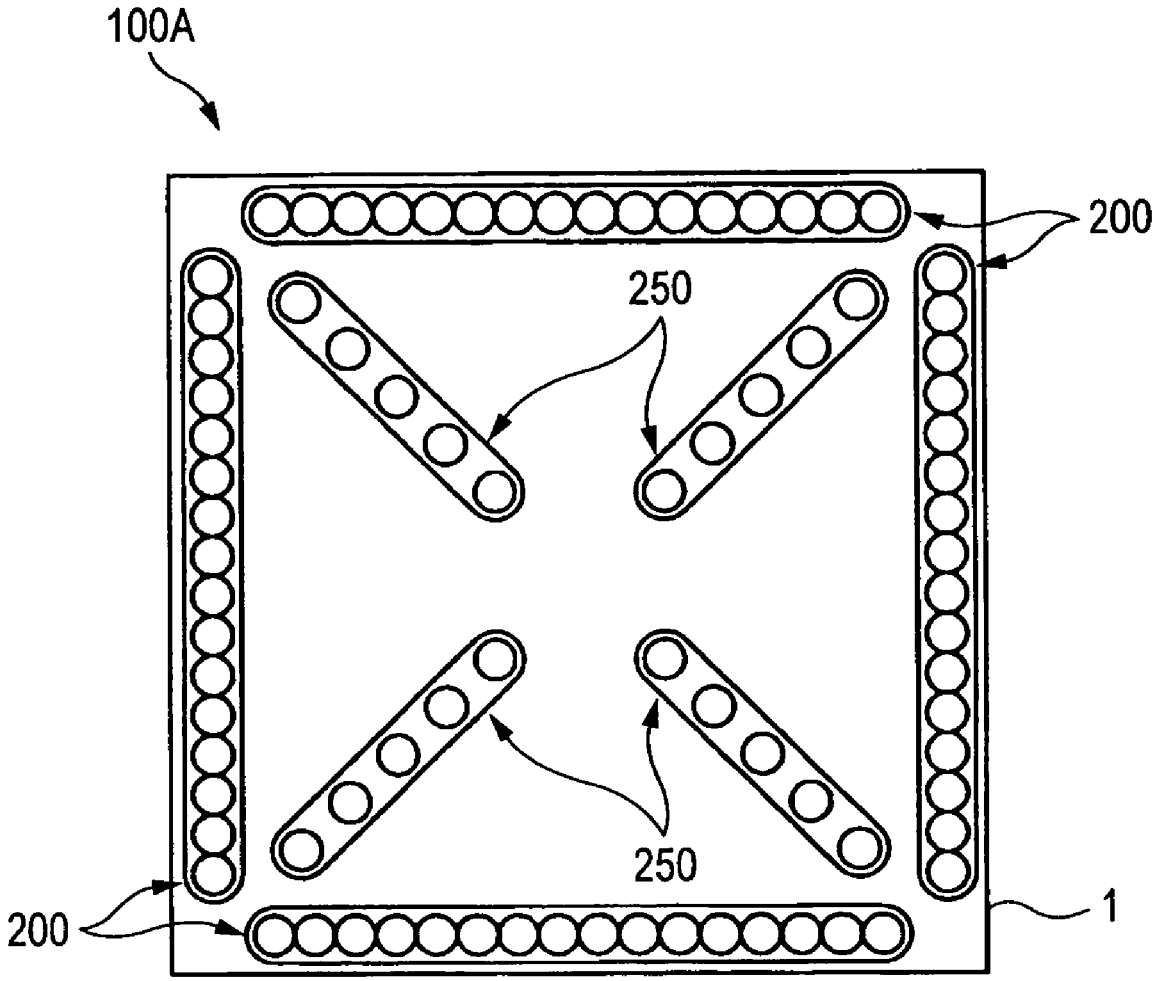
[FIG. 11] A bottom view representing a modification example 1 of an illuminating panel having more linear light source units added thereto in diagonal directions.

FIG. 11 is a bottom view representing a modification example 1 of an illuminating panel having more linear light source units added thereto in diagonal directions.

An illuminating panel 100A according to the modification example 1 has a pair of linear light source units 250 and 250 linearly disposed in each diagonal direction of the module panel 1. Consequently, a total of eight linear light source units 200 are disposed on the module panel 1.

According to the illuminating panel 100A of the modification example 1, as a total light quantity of the illuminating panel can be increased by an amount equivalent to a light emission quantity of four linear light source units added along the diagonals, and an illuminance can be further heightened with an identical area of the module panel 1.

Figure 12:
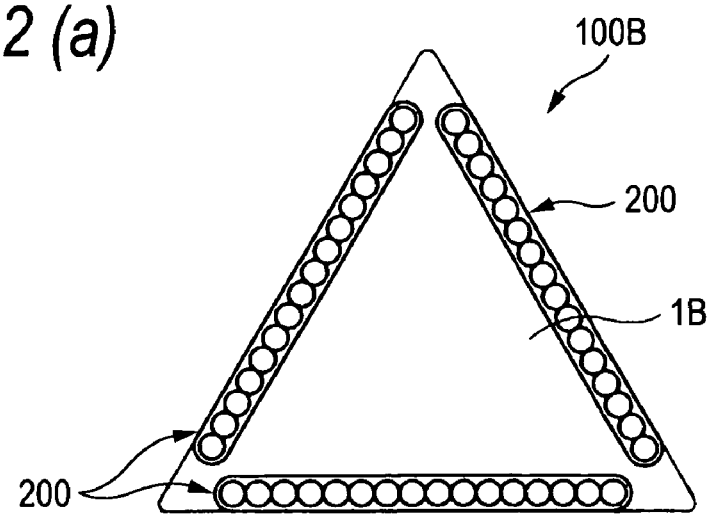
[FIG. 12] A bottom view representing a modification example 2 in which the linear light source units are arranged in a triangle (a) and a hexagon (b)
Figure 12:
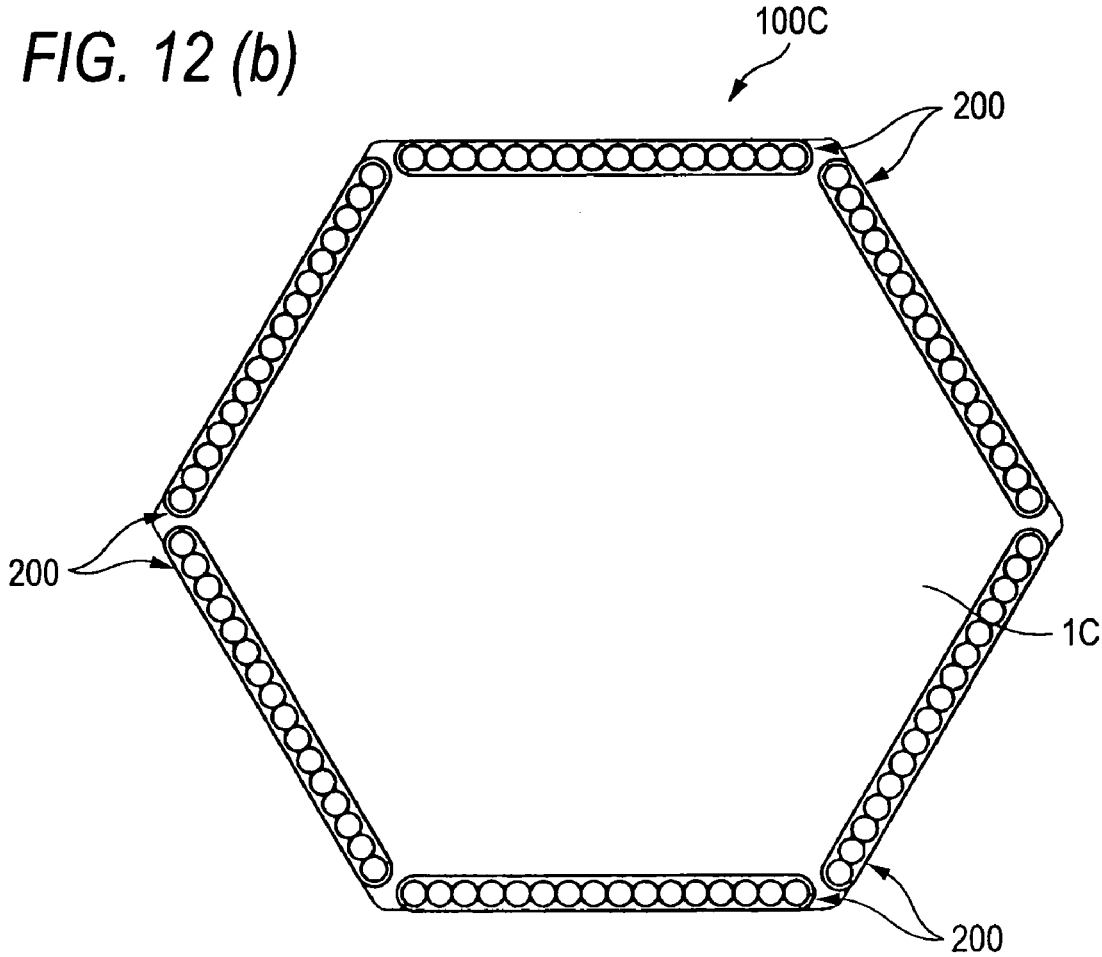

FIG. 12 is a bottom view representing a modification example 2 in which the linear light source units are arranged in a triangle (a) and a hexagon (b).

Also, in the illuminating panel 100, it is also acceptable that the module panel 1 is formed into a polygon other than a square. That is, in an illuminating panel 100B shown in FIG. 12(*a*), a module panel 1B is formed into a triangle, and the linear light source unit 200 is disposed on each side thereof.

According to the illuminating panel 100B, by the polygonal shape being a triangle, a number of linear light source units 200 can be reduced by one as compared with a case of a square, making it possible to reduce the module panel 1 in size while expanding emergent light from each side uniformly in three directions from a center of the irradiated area.

Also, as shown in FIG. 12(*b*), it is also acceptable to configure an illuminating panel 100C in such a way that a module panel 1C is formed into a hexagon, and the linear light source units are disposed on each side thereof.

According to the illuminating panel 100C, by the polygonal shape being a hexagon, it is possible to increase a light quantity while expanding emergent light from each side uniformly in six directions from a center of the irradiated area, making it possible to further heighten the illuminace of the overlapping irradiated area Sh. Although FIG. 12 shows the cases of a triangle and a hexagon by example, it is also acceptable that the shape of the module panel 1 is of any polygon other than these and, also in that case, the linear light source units 200 are configured to be disposed on each side.

Figure 13:
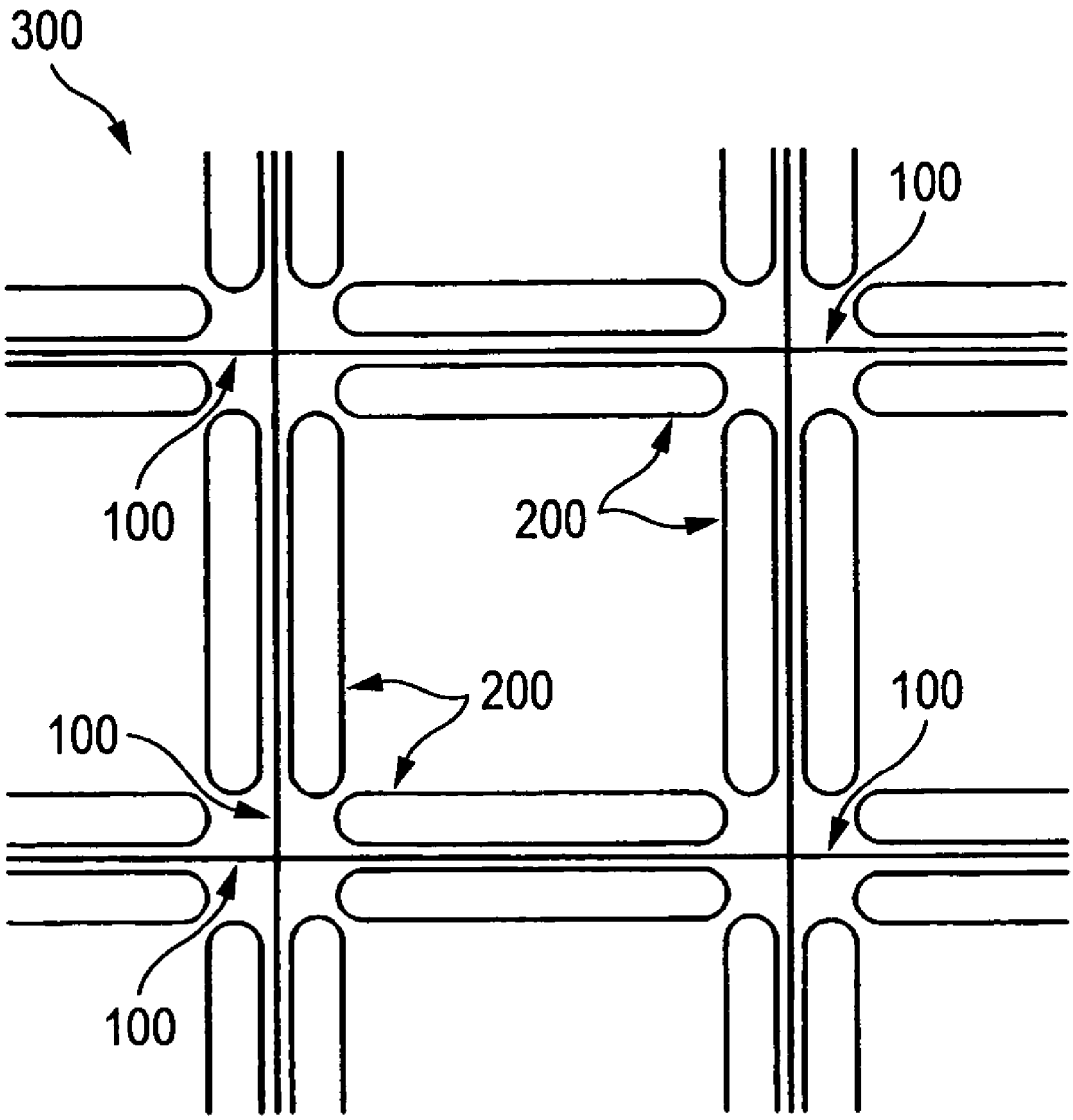
[FIG. 13] A bottom view representing a modification example 3 in which, as the illuminating device, a plurality of illuminating panels are connected and developed in a direction of the plane of the figure.
Figure 14:
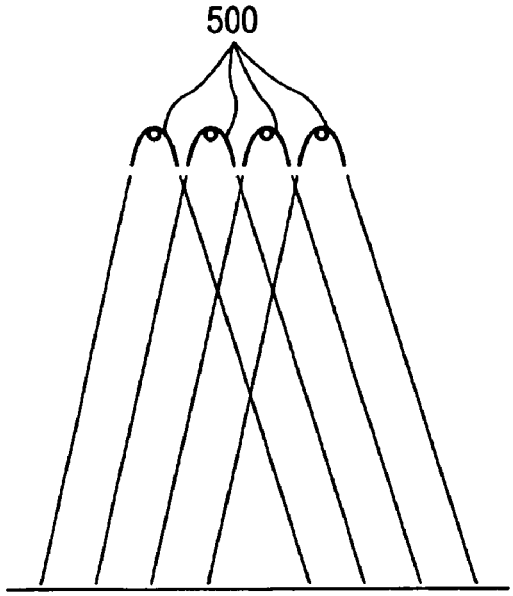
[FIGS. 14(*a*)-14(*c*)] are illustrations representing a disposition of hitherto known luminaries and an illuminance distribution obtained by them.
Figure 14:
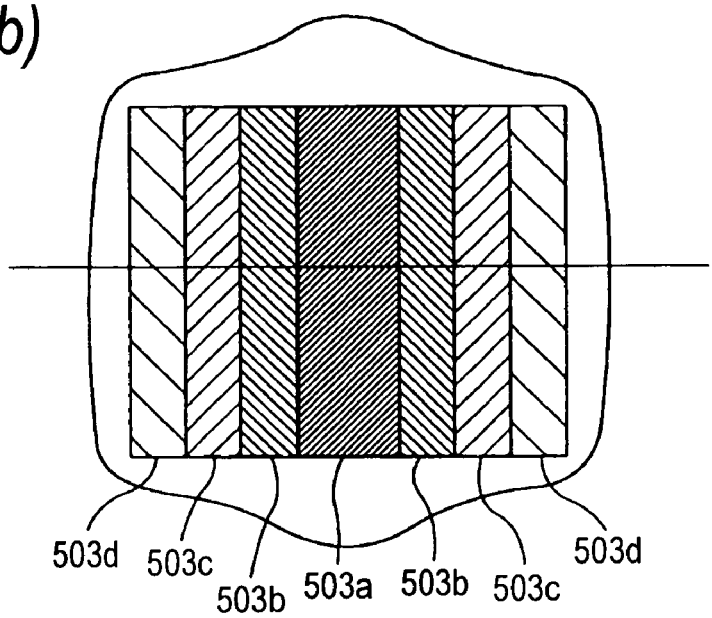
Figure 14:
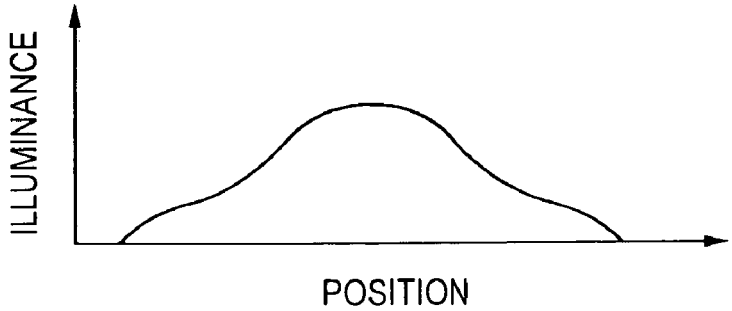

FIG. 13 is a bottom view representing a modification example 3 in which, as the illuminating device, a plurality of illuminating panels are connected and developed in a direction of the plane of the figure.

By connecting a plurality of the illuminating panels 100, it is possible to configure an illuminating device 300 as a whole of them. In a case of square illuminating panels 100, as shown in FIG. 13, by connecting them in a matrix, they are arranged in an array formation on an identical plane.

In this way, by minimum unit module panels (that is, the illuminating panels 100) each having a plurality of linear light source units 200 annularly provided thereon being continuously arrayed (continued), an overlapping irradiated area having a high illuminance and a uniform illuminance distribution can be easily developed into an optional width. In this case, it is preferable that not-shown male connection means and female connection means are alternately provided circumferentially on each side of the module panel 1 (that is, connection means of a kind are provided on opposed parallel sides). By this means, an easy connection and development in four directions is possible while individual connection sides are being connected by the male connection means and the female connection means. A distance between adjacent linear light source units 200 can be set to an optional one by adjusting a distance by which each of them is spaced away from a side of the corresponding module panel 1.

Apart from the heretofore described configuration, a configuration is also acceptable in which a rail which, as well as supporting one illuminating panel, enables the illuminating panel to move along it, is provided, and the illuminating panel is moved along the rail to a desired position in such a way that an area desired to be illuminated is irradiated with light. In this case, a spot illumination can be easily applied to an area required to be illuminated.

Although the invention has been described in detail with reference to a specified embodiment, it is manifest to those skilled in the art that various alternations and modifications can be made without departing from the spirit and scope of the invention.

The present application is based on Japanese Patent Application No. 2005-249984 filed on Aug. 30, 2005, and contents thereof are incorporated herein as a reference.

The invention claimed is:

1. An illuminating panel comprising:

a module panel; and a plurality of linear light source units disposed thereon, each of the linear light source units comprising:

a light emitter having a base and a plurality of light emitting diodes linearly installed on the base;

a first reflector formed of parabolic surfaces that are provided for each of the light emitting diodes on a light emergence side, each of the parabolic surfaces having a focal position being set at a light emitting face of the respective light emitting diodes; and a second reflector having a pair of flat plate-like reflecting surfaces being arranged with the light emitting diodes sandwiched therebetween, the second reflector being disposed farther to the light emergence side than the first reflector and parallel to an array direction of the light emitting diodes, and the second reflector reflecting light from the light emitting diodes toward the light emergence side, wherein the linear light source units are annularly disposed on the module panel, and wherein said second reflector comprises a first end adjacent to said first reflector and a second end opposite to said first end, said flat plate-like reflecting surfaces extending from said first end to said second end.

2. The illuminating panel according to claim 1, wherein the linear light source units are disposed along each side of the module panel that is formed in a polygonal shape.

3. The illuminating panel according to claim 2, wherein the polygonal shape comprises a square.

4. The illuminating panel according to claim 2, wherein the polygonal shape comprises a triangle.

5. An illuminating device comprising a plurality of the illuminating panels according to claim 1, wherein the illuminating panels are connected and arranged in an array formation.

6. An illuminating device comprising a plurality of the illuminating panels according to claim 2, wherein the illuminating panels are connected and arranged in an array formation.

7. An illuminating device comprising a plurality of the illuminating panels according to claim 3, wherein the illuminating panels are connected and arranged in an array formation.

8. An illuminating device comprising a plurality of the illuminating panels according to claim 4, wherein the illuminating panels are connected and arranged in an array formation.

9. The illuminating device according to claim 1, further comprising:

a reflecting mirror member which comprises:

an attachment base plate;

the first reflector; and the second reflector, wherein each of the parabolic surfaces is connected to the attachment base plate.

10. The illuminating device according to claim 9, wherein a rear plate of each of the linear light source units is attached to the reflecting mirror member, and wherein each of the linear light source units has a height in a range of 15 mm to 30 mm.

11. The illuminating device according to claim 1, wherein the pair of flat plate-like reflecting surfaces are disposed in a direction perpendicular to an array direction of the parabolic surfaces.

12. The illuminating device according to claim 10, wherein the rear plate comprises:

a shade;

a rib for supporting a back side of the base on an inner surface of the shade; and plural locking claws formed at a plurality of points in a longitudinal direction of the shade for engaging the reflecting mirror member.

13. The illuminating device according to claim 10, wherein the reflecting mirror member comprises:

a bracket for securing each of the linear light source units; and engagement portions provided in a vertical direction of the attachment base plate for engagement with the locking claws of the rear plate.

14. The illuminating device according to claim 13, wherein the reflecting mirror member, the base, and the rear plate are removably fitted together by a snap engagement of the engagement portions with the locking claws of the rear plate such that the base is sandwiched between the reflecting mirror member and the rear plate.

15. The illuminating device according to claim 1, wherein the flat plate-like reflecting surfaces comprise planar mirrors.

16. A method of equalizing illuminance distribution using a polygonal illuminating device, comprising:

reflecting a first light from a light emitting diode toward a light emergence side using a parabolic mirror of a first reflector, said first reflector having an opening at a promixal end where a light emitting face of said light emitting diode is disposed in a focal position of the parabolic mirror, said parabolic mirror having a parabolic reflecting surface;

reflecting a second light from the light emitting diode that has not been projected onto the first reflector toward the light emergence side using a flat planar mirror plate of a second reflector, said second reflector reflecting said second light such that said second light is made parallel, said second reflector provided farther to the light emergence side than the first reflector; and converting said first light and said second light into parallel light.

17. The method of equalizing illuminance distribution according to claim 16, wherein a gradient angle of said flat planar mirror plate with respect to an optical axis of said light emitting diode is set such that said first light from said light emitting diode is converted into said parallel light.

18. The method of equalizing illuminance distribution according to claim 17, wherein said gradient angle is in a range from 20° to 27° with respect to the optical axis of the light emitting diode.

19. An illuminating panel comprising:

a module panel; and a plurality of linear light source units disposed thereon, each of the linear light source units comprising:

a light emitter having a base and a plurality of light emitting diodes installed on the base;

a first reflector formed of parabolic surfaces that are provided for each of the light emitting diodes on a light emergence side, each of the parabolic surfaces having a focal position being set at a light emitting face of the respective light emitting diodes; and a second reflector having a pair of reflecting surfaces being arranged with the light emitting diodes sandwiched therebetween, the second reflector being disposed farther to the light emergence side than the first reflector and parallel to an array direction of the light emitting diodes, and the second reflector reflecting light from the light emitting diodes toward the light emergence side, wherein the linear light source units are annularly disposed on the module panel, and wherein said module panel is provided with three or more of said linear light source units.

20. The illuminating panel according to claim 19, wherein the linear light source units are disposed along each side of the module panel.

21. The illuminating panel according to claim 19, wherein said module panel is formed in a polygonal shape.

22. The illuminating panel according to claim 21, wherein the polygonal shape comprises a square.

23. The illuminating panel according to claim 21, wherein the polygonal shape comprises a triangle.

24. The illuminating panel according to claim 21, wherein said polygonal shape comprises a hexagon.

25. An illuminating device comprising a plurality of the illuminating panels according to claim 19, wherein the illuminating panels are arranged in an array formation.

26. An illuminating device comprising a plurality of the illuminating panels according to claim 20, wherein the illuminating panels are arranged in an array formation.

27. An illuminating device comprising a plurality of the illuminating panels according to claim 21, wherein the illuminating panels are arranged in an array formation.

* * * * *